US006418724B1

(12) United States Patent
Cheng

(10) Patent No.: US 6,418,724 B1
(45) Date of Patent: Jul. 16, 2002

(54) METHOD AND APPARATUS TO HOMOGENIZE FUEL AND DILUENT FOR REDUCING EMISSIONS IN COMBUSTION SYSTEMS

(75) Inventor: Dah Yu Cheng, Los Altos Hills, CA (US)

(73) Assignee: Cheng Power Systems, Inc., Mountain View, CA (US)

( * ) Notice: Subject to any disclaimer, the term of this patent is extended or adjusted under 35 U.S.C. 154(b) by 0 days.

(21) Appl. No.: 09/591,407

(22) Filed: Jun. 12, 2000

(51) Int. Cl.[7] ..... F02C 3/22; F02C 3/30

(52) U.S. Cl. ..... 60/775; 60/776; 60/39.55; 60/742; 60/39.26; 431/162; 431/163

(58) Field of Search ..... 60/39.05, 39.06, 60/39.55, 39.463, 742, 737, 39.26, 775, 776; 431/162, 163

(56) References Cited

U.S. PATENT DOCUMENTS 3,804,579 A * 4/1974 Wilhelm ..... 60/737
3,921,389 A * 11/1975 Kawaguchi ..... 60/39.05
3,982,878 A * 9/1976 Yamane et al. ..... 60/39.55
4,025,282 A * 5/1977 Reed et al. ..... 60/39.463
4,041,699 A * 8/1977 Schelp ..... 60/39.55
4,110,973 A * 9/1978 Haeflich et al. ..... 60/39.05
4,147,025 A * 4/1979 Friendrich et al. ..... 60/39.06
4,189,914 A * 2/1980 Marek et al. ..... 60/39.06
4,302,177 A * 11/1981 Frankhanel et al. ..... 431/163
4,657,009 A * 4/1987 Zen ..... 60/39.55
5,163,511 A * 11/1992 Amundson et al. ..... 431/163
5,617,716 A * 4/1997 Schreiber et al. ..... 60/39.05
5,983,622 A * 11/1999 Newburry et al. ..... 60/39.05

* cited by examiner

*Primary Examiner*—Ted Kim
(74) *Attorney, Agent, or Firm*—Cooper & Dunham LLP

(57) ABSTRACT

A method and apparatus for reducing emissions in combustion systems, particularly gas turbines. A mixture of diluent and fuel is created, wherein the diluent and the fuel are at a predetermined diluent-to-fuel ratio. The mixture is homogenized to create a homogenized mixture having a uniform concentration distribution of the diluent and the fuel at the predetermined diluent-fuel ratio. Thereafter, the homogenized mixture is introduced into a flame zone and the homogenized mixture is combusted.

47 Claims, 13 Drawing Sheets

Unburned Diffusion Flame

Combustion Case

Concentration

| Materials Increase Flame Stability | |
|---|---|
| Third Gas | Limits |
| Air | <stoichiometric |
| $H_2$ | 5% ~10% |
| $H_2O_2$ | 5% |
| Rocket Fuel | Pinch |
| Pre-Ignition Fuel | to > 1000° F |

FIG. 12

METHOD AND APPARATUS TO HOMOGENIZE FUEL AND DILUENT FOR REDUCING EMISSIONS IN COMBUSTION SYSTEMS

FIELD

The disclosure herein relates to the field of combustion systems, and more particularly, to a system for reducing emissions in combustion systems.

BACKGROUND

The reduction of harmful emissions has been a longstanding goal in the design of combustion systems, particularly power plants. The predominant emissions from gas turbine power plants are the oxides of nitrogen, or $NO_x$. The most prevalent $NO_x$ emissions are nitric oxide, NO, and nitrogen dioxide, $NO_2$.

Although many combustion systems use natural gas, which is one of the cleanest-burning fuels, the NOx levels of these combustion systems remain relatively high. For example, in the standard household kitchen stove, the burner flame releases NOx emissions at about 48 parts per million (ppm). Other devices such as gas barbecue stands, hot water heaters, and Bunsen Burners also release NOx emissions at approximately that level. Therefore, there is a need to further reduce NOx emissions for combustion systems, particularly in power plants, but also in other combustion systems. Although electricity is the cleanest energy option, NOx emissions still occur, concentrated at the source where electricity is generated (i.e., at the power plants).

NOx emissions are produced by a high-temperature reaction of the nitrogen and oxygen contained in air. Reducing the combustion temperature reduces the level of NOx emissions. However, a reduction of the combustion temperature generally slows down the chemical reaction of carbon combustion, thereby generating high levels of carbon monoxide. For this reason, gas turbine combustion systems and natural gas burning power plants usually use a diluent such as steam or water spray in order to reduce the flame temperature.

Mixing steam and water creates turbulence, effectively increasing the diffusivity of the oxygen to be mixed with the fuel for combustion. Water droplets in the flame front evaporate rapidly, creating a phenomena known as "microexplosions." While the injection of steam or water creates turbulence and reduces the flame temperature, the water vapor becomes an additional inert gas (other than nitrogen) with a high heat capacity. It has been shown that the use of such diluents in a gas turbine significantly reduces NOx emission levels, for example, to lower than 25 ppm.

NOx reduction improvements have stagnated, and a need remains to add further reduction means to combustion systems to reduce the NOx emission levels even more. Existing devices can be expensive and difficult to operate, and sometimes even create other emissions themselves. One such device is a selective catalytic reduction system (SCR), which uses ammonia and a catalyst to reduce the NOx emissions. A selective catalytic reduction system can normally reduce NOx emissions by 90% in the flue gas. However, ammonia itself can be a dangerous substance, and under high temperature conditions, ammonia can react violently with water, causing bums and eye injuries. Ammonia also decomposes into nitrogen and hydrogen, which is an undesired and unproductive result. Therefore, there is a need to further reduce NOx emissions of combustion systems through more practical and effective means.

FIG. 1 shows the structure of a typical diffusion flame. The gaseous fuel enters through a nozzle 10 and is supported by a diffusion flame such as a fuel injector or a candle. The flame structure can be simplified into a paralysis zone 12 (shown cross-hatched in the middle), a fuel diffusion zone 14, and a flame surface 16. Oxygen is diffused from the surrounding area toward the flame surface. Under the diffusion flame structure, the combustion reaction can only take place on the flame surface 16 when the fuel and oxidizer reach the stoichiometric ratio. The temperature at the flame surface therefore remains substantially constant and independent of the rate at which fuel is emitted into the nozzle 10. The change to a higher fuel emission rate would cause a larger flame surface.

The heat from the flame surface transfers back to the center of the fuel supply, causing the fuel to be paralyzed into smaller chemical elements such as carbon and hydrogen. These smaller elements diffuse toward the flame surface to support the combustion process. The combustion heat is divided between the combustion products and ambient inert gas. If the surrounding gas is air, then nitrogen will remove some of the heat without participating in the chemical reaction, thereby lowering the overall flame surface temperature. However, if the gas is pure oxygen, the flame surface will reach its highest possible combustion temperature. A gas that does not react with oxygen also can act as an inert gas, removing heat from the flame temperature without participating in the chemical reaction and thereby further lowering the flame temperature.

FIG. 2*a* illustrates a typical mutual diffusion profile of fuel and oxidizer without combustion. That is, FIG. 2*a* represents a diffusion phenomena of fuel and oxidizer as a concentration profile with respect to distance from the centerline (i.e., from the source of the fuel or the middle of the paralysis zone) without combustion. The x-axis represents the distance from the source of the fuel. No chemical reaction has taken place in FIG. 2*a*. In FIG. 2*b*, when the chemical reaction occurs, in the form of combustion, the concentrations of fuel and oxidizer both approach zero at the flame surface. The concentration of the combustion products is highest at the flame surface. Despite the disappearance of fuel and oxidizer, however, the flame maintains the diffusion rate present when the concentrations of fuel and oxidizer are at the stoichiometric ratio, as illustrated in FIG. 2*a*.

FIG. 3 illustrates the flame height as a function of turbulence level with an increasing fuel nozzle jet velocity. The left side shows a very long flame having a height that increases along with the fuel jet velocity. The flame is a laminar flame. The right side shows the flame as the fuel jet velocity increases. Although the height of the flame decreases at first, an increase of the fuel jet velocity eventually keeps the turbulent diffusion flame at a constant height. With the laminar flame on the left side, the flame diffusion is strictly molecular. Therefore, the surface area of the flame remains proportional to the fuel ejection rate from the fuel nozzle. When the velocity continues to increase, it induces turbulent mixing which greatly increases the molecular diffusivity. The jet of the fuel nozzle finally reaches a condition known as a similarity flow, which means that the flame is at a constant flame height. The similarity flow occurs when the turbulent mixing profile becomes independent of the magnitude of the velocity.

When the chemical reaction rate is slower than the turbulent diffusion rate, the flame will be lifted from the fuel nozzle, creating a blowout condition. FIG. 4 illustrates combustion flame profiles with respect to blowout conditions. FIG. 4*a* illustrates the condition of fuel with an extremely high jet velocity. In order to improve the chemical reaction rates and stabilize the flame, some of the combustion products are recirculated through turbulent mixing as chemical reaction seed material. The bell-shaped profile in FIG. 4*a* illustrates the root of the flame, and the cone-shaped region represents the turbulent combustion of fuel and air. When the velocities of both fuel and air increase, the root of the flame lifts away from the nozzle, leaving certain recirculation chemical species to support the combustion. As illustrated in FIG. 4*b*, when the velocity increases, the recirculation is reduced, causing the flame to lift away from the nozzle and creating a neutral condition. FIG. 4*c* illustrates the results of a maximum increase in the velocities of both the jet and air. Chemical species can no longer recirculate, and the flame completely lifts from the nozzle, creating a blowout condition. Candles illustrate this phenomena well: when one blows gently on a candle, the combustion rate of the candle increases. However, as one blows harder on the candle, the combustion rate catches up to the diffusion rate, thereby extinguishing the flame.

As mentioned above, a particular need is to reduce the level of NOx emissions in gas turbines. The publication "Fundamentals of Gas Turbines, Second Edition," William W. Bathie, provides a detailed description of gas turbines, and is hereby incorporated by reference. FIG. 5 illustrates a typical gas turbine combustion system. The outside liner 20 has many dilution holes 30. A pre-mixing swirler 40 surrounds a fuel nozzle 50. The dilution holes 30 create a recirculation flow which serves to guide the combustion product back into the primary combustion zone to help accelerate the chemical reaction of combustion. The swirler 40 creates the fundamental turbulent mixing for the fuel jet as the fuel exits the hole 51. This design uses recirculation and turbulence to establish a similarity flow. The combustion products then mix with dilution air through the dilution holes 30 to reach a final temperature before entering the nozzle of the gas turbine.

FIG. 6 illustrates prior art devices used in the industry. A concentric nozzle 61 has fuel and diluent injections for creating a turbulent flame. Specifically, one conduit supplies fuel, while the other supplies steam or water. The concentric nozzle 61 is surrounded by another system 63. The turbulence of the fuel, and the high velocity of the diluent (such as a steam jet or water spray), usually create the flame mixing region. The steam, fuel, and air are mixed while burning or combusting. A problem with this prior art device is that the length of the mixing depends on the geometry of the nozzle for a turbulent jet; therefore, the concentrations are not homogeneous. Some places have more fuel than other places, which does not ensure that the steam, fuel, and air is a homogenous mixture. As a result, "hot spots" are produced and the NOx level is relatively high. As explained with regard to FIG. 1, the temperature of the flame surface is uncontrollable by bulk mixing. In fuel-rich regions, the flame temperature can still reach a very high level and produce NOx.

"Homogenous" as used in this specification means a concentration deviation from the average, with average being 100% homogeneous. For example, if a closed vessel contains on average 50% fuel and 50% air, and in a localized region actually contains 49% fuel and 51% air, then the concentration deviation from the average, or from the overall ratio of components, is 2%, denoting 98% homogeneity.

The concentration deviation from the average of prior art devices using turbulent mixing is believed to be in the approximate range of 15%–25%, or, a range of homogeneity from 75%–85%. It is an object of the disclosure herein to significantly improve upon the percentage of homogeneity present in prior art combustion systems.

FIG. 7 illustrates a traditional coaxial mixing of a jet of fuel surrounded by another gas (in this case, air). The solid contour lines represent fuel concentration. For example, a fuel concentration of 0.1 represents 10% fuel and 90% air. Although 1.0 is not marked on the figure, it is indicated by the last contour of fuel coming out over the nozzle. The data relating to FIG. 7 showed that even at more than 20 diameters downstream of the fuel nozzle, the homogeneous mixing was nowhere near completion. Therefore, the turbulent flame creates uncertainties in terms of concentration fluctuations as represented by the dash lines in the region containing a 50/50 mixture average. If the surrounding gas is steam, then this mixture represents rich and lean regions of fuel mixed with steam. The turbulent properties and fluctuation intensity of this mixture subject it to different temperature fluctuations. Unfortunately, a region with a higher fuel concentration will have a higher flame temperature, and, consequently, produce a higher level of NOx emissions. Because of this, this prior art nozzle design has not been able to achieve a NOx level below approximately 20 ppm in gas turbines burning natural gas.

FIG. 8 shows typical plots of NOx and CO productions based on a well-stirred combustion situation as a function of flame temperature. This graph was generated assuming that the turbulence levels were high enough for combustion to occur at ratios other than the stoichiometric ratio. These plots illustrate the best attempts at reducing NOx productions with a highly turbulent, lean, well-stirred combustion situation. Previously used as the most advanced technology in gas turbines, these systems are called Dry Low NOx Combustion Systems (DLN). The word Dry (D) indicates a lack of mixture with steam or water. It is clear that further NOx reductions are needed.

SUMMARY

One object of the disclosure herein is to reduce the level of NOx emissions in combustion systems well below that of natural flame processes. To achieve this object, the disclosure herein teaches to homogeneously pre-mix the fuel with a diluent, such as steam, before it enters the diffusion flame system. To eliminate the hot spots in a turbulent flame, the concentration distribution of a turbulent jet using the teachings of the disclosure herein becomes uniform. Another object of the disclosure herein is to simplify combustion systems by using a static mixer to save space in the system. Another object is to sustain lean combustion without flameouts, using homogeneous mixing and a pilot third gas. Ultimately, the disclosure herein greatly reduces NOx emissions in combustion systems at a decreased cost by means of a simplified arrangement.

The disclosure herein in a preferred embodiment provides a method for reducing emissions in a combustion system, comprising the steps of creating a mixture of diluent and fuel, wherein the diluent and the fuel are at a predetermined diluent-to-fuel ratio, homogenizing the mixture to create a homogenized mixture having a uniform concentration distribution of the diluent and the fuel at the predetermined diluent-fuel ratio, and, thereafter, introducing the homogenized mixture into a flame zone and combusting the homogenized mixture.

The diluent can be steam. The homogenizing step can be performed by a compact mixer. The homogeneity of the homogenized mixture is preferably in the range of 97–99%. A third gas such as air, hydrogen, or hydrogen peroxide may be added to the mixture before the homogenizing step. The predetermined diluent-to-fuel ratio is preferably in the range of 0.2 to 1, or 0.2 to 3. "Ratio" as used in this specification means the ratio by weight of components.

The disclosure herein in another embodiment provides a gas turbine. The gas turbine has a compressor and a chamber disposed downstream of the compressor for receiving diluent and fuel at a predetermined diluent-to-fuel ratio to form a mixture. A compact mixer is disposed downstream of the chamber for homogenizing the mixture to create a homogenized mixture having a uniform concentration distribution of the diluent and the fuel at the predetermined diluent-fuel ratio. A combustion section is disposed downstream of the compact mixer for combusting the homogenized mixture after the homogenized mixture leaves the compact mixer to produce a hot energetic flow of gas. A turbine is disposed downstream of the combustion section driven by the hot energetic flow of gas for driving the compressor.

Experiments have proven the teachings of the disclosure herein, wherein the mixture of gaseous fuel and diluent is homogenized, to be effective for reducing emissions in combustion systems.

BRIEF DESCRIPTION OF THE DRAWINGS

FIG. 12 is a table showing third gases available to act as a pilot; and

DETAILED DESCRIPTION OF THE PREFERRED EMBODIMENTS

As is evident from the above-described background, there is a need to further reduce emissions in combustion systems. A homogeneous mixing of diluent (such as steam) and fuel operates to decrease then the nitrogen concentration of the flame. The disclosure herein uses certain dry low NOx principles, but also uses a well-stirred mixture of steam and fuel to achieve more effective results, since the steam replaces nitrogen as one of the participants in the flame zone. If the nitrogen concentration in the flame zone decreases, then the production of NOx can be expected to decrease. The disclosure herein teaches a homogeneous mixing of steam and fuel first, and then an intermixture with turbulent air so that the concentration remains uniform.

Figure 1:
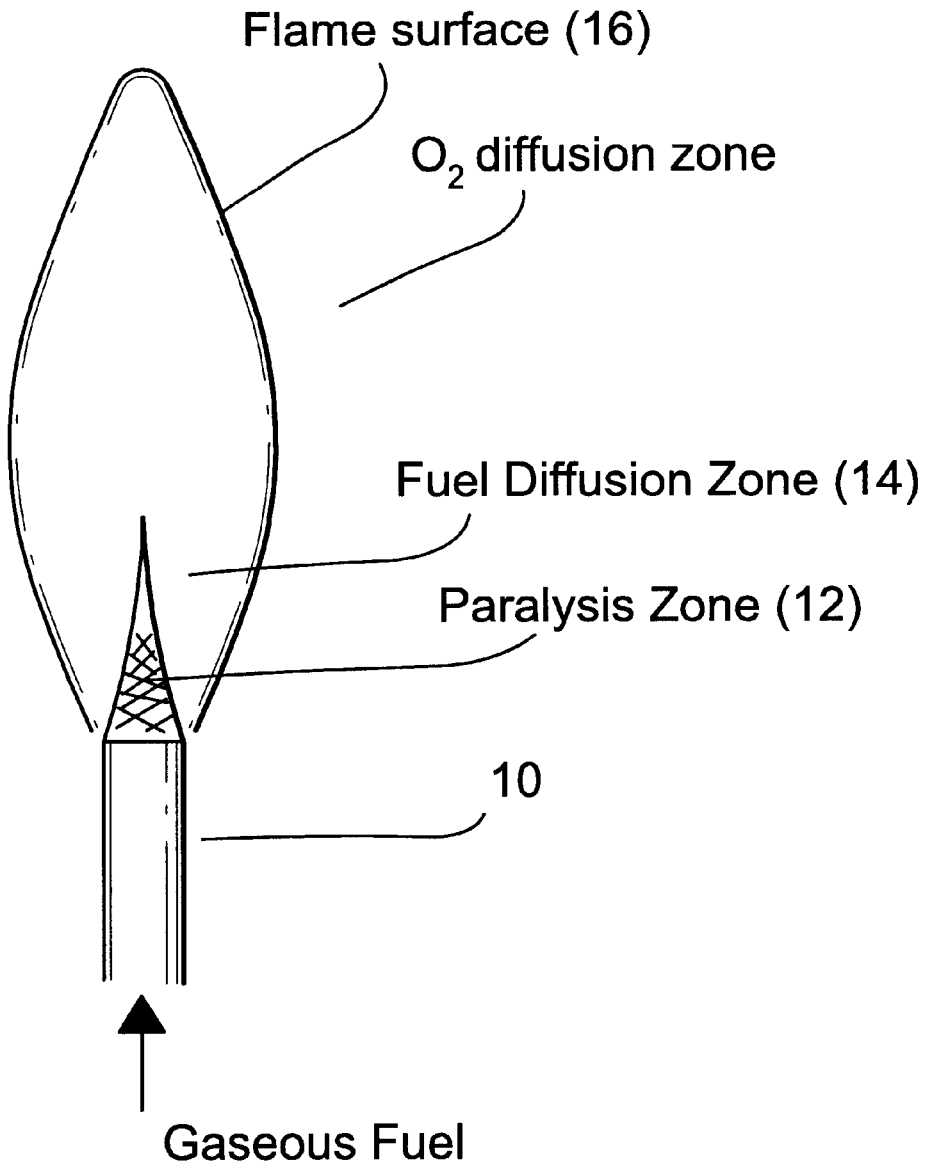
FIG. 1 illustrates the structure of a typical diffusion flame.
Figure 2A:
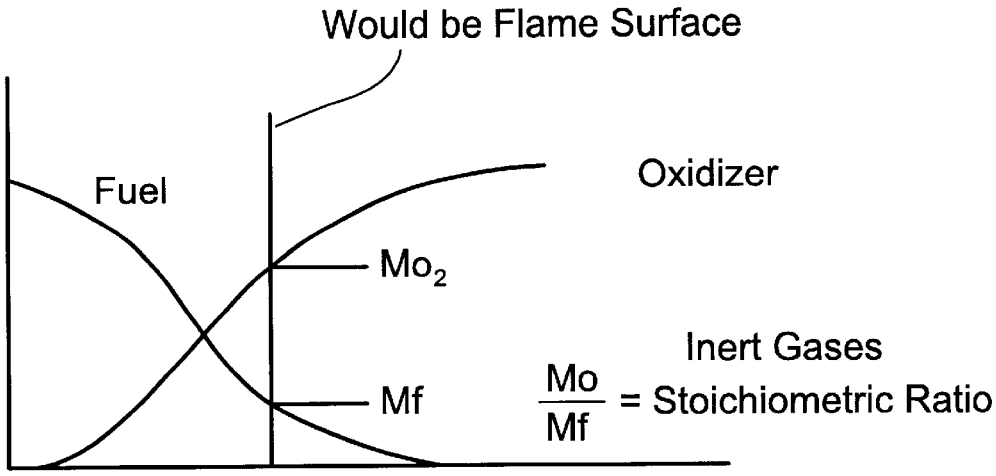
FIG. 2*a* illustrates a typical mutual diffusion profile of fuel and oxidizer without combustion.
Figure 2B:
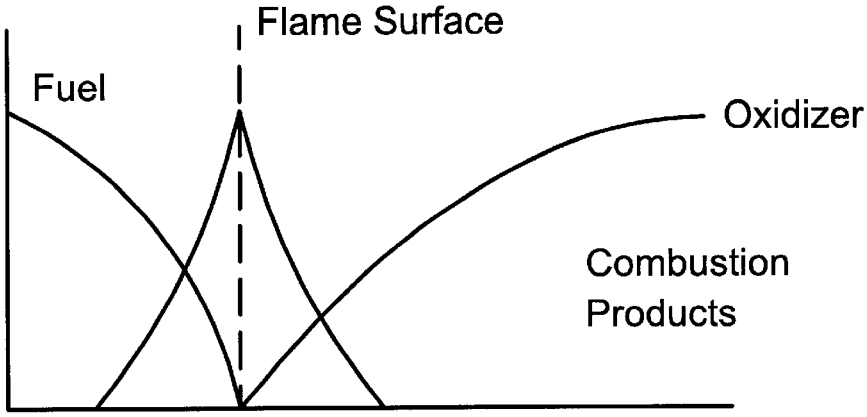
FIG. 2*b* represents the diffusion of fuel, oxidizer, and combustion products with combustion.
Figure 3:
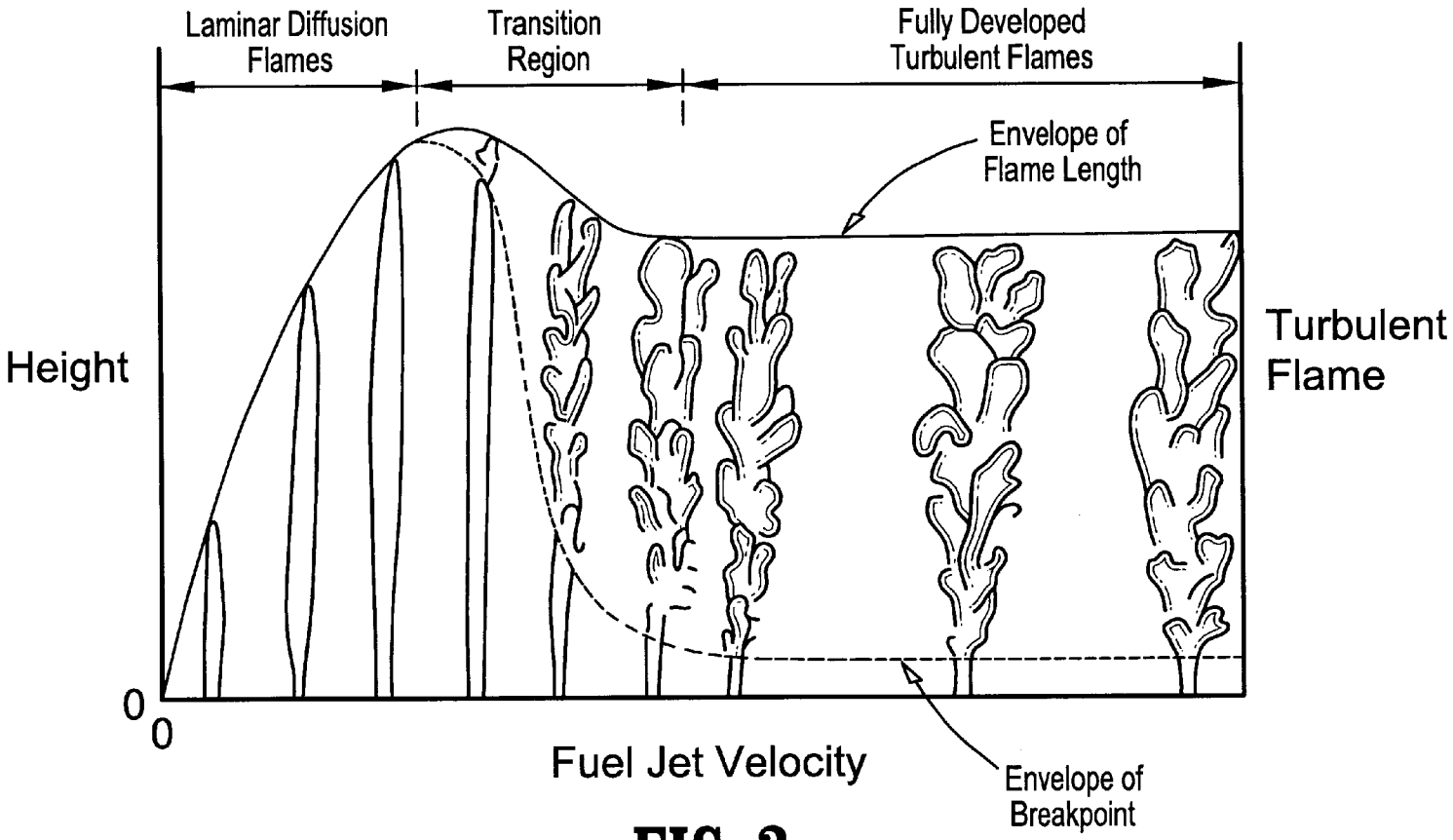
FIG. 3 illustrates the flame height as a function of fuel ejection velocity.
Figures 4A, 4B, 4C:
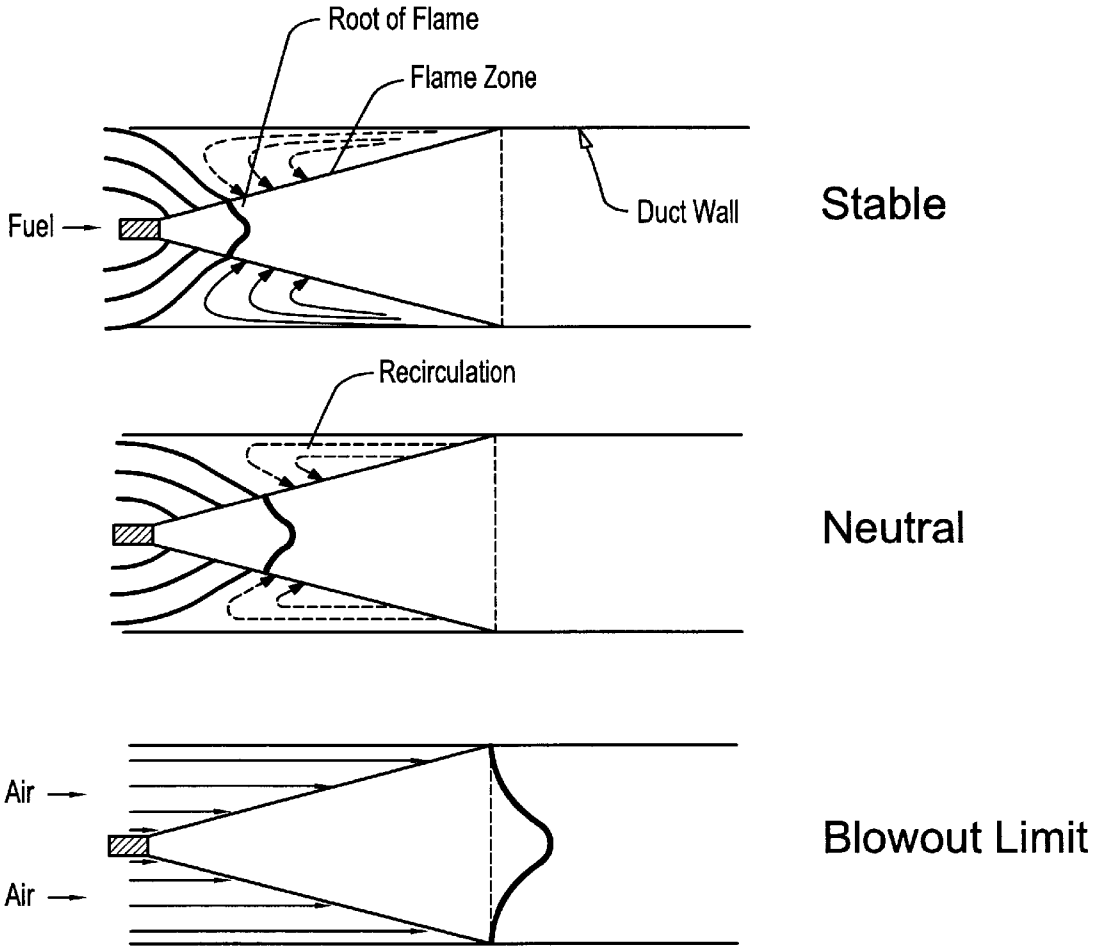
FIGS. 4*a*, 4*b*, 4*c* illustrate combustion flame profiles with respect to blowout conditions.
Figure 5:
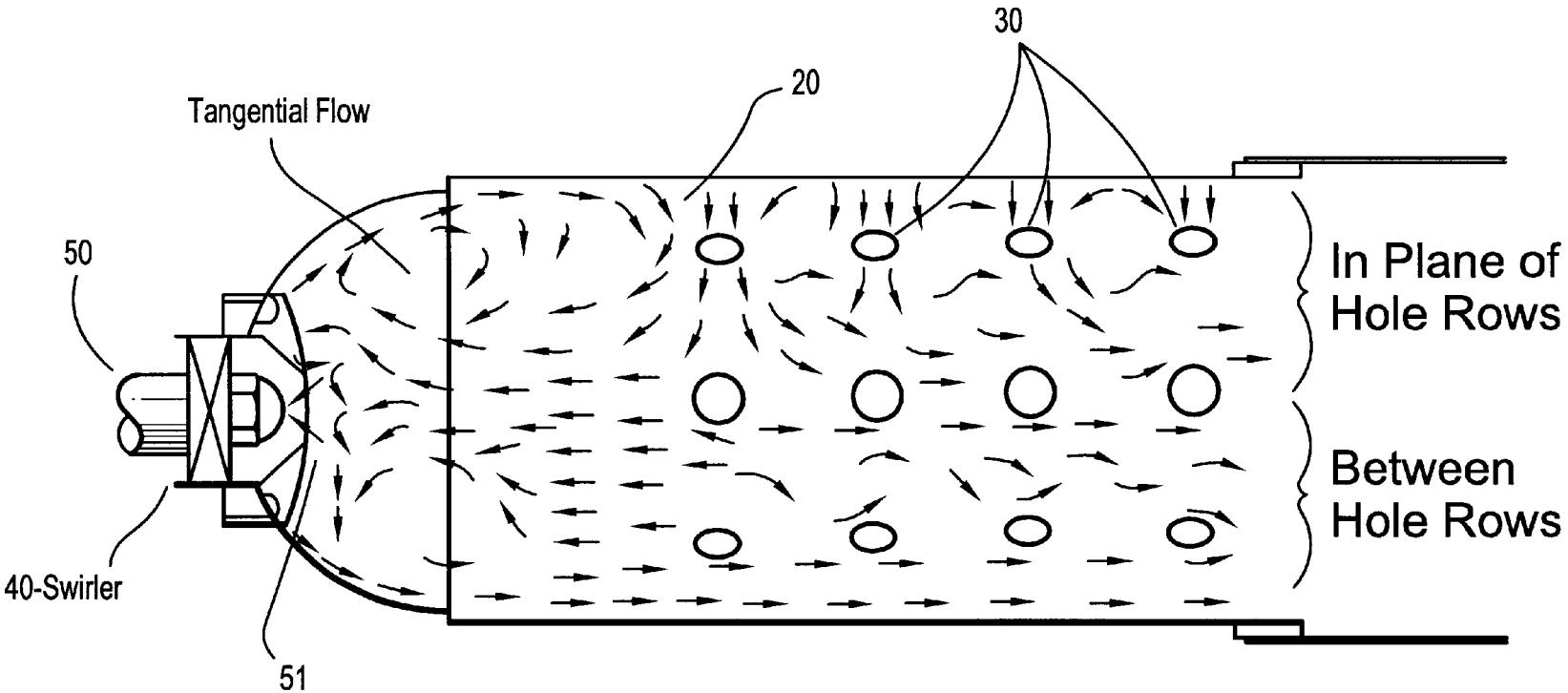
FIG. 5 (Prior Art)
FIG. 5 illustrates a typical combustion liner structure in a jet engine.
Figure 6:
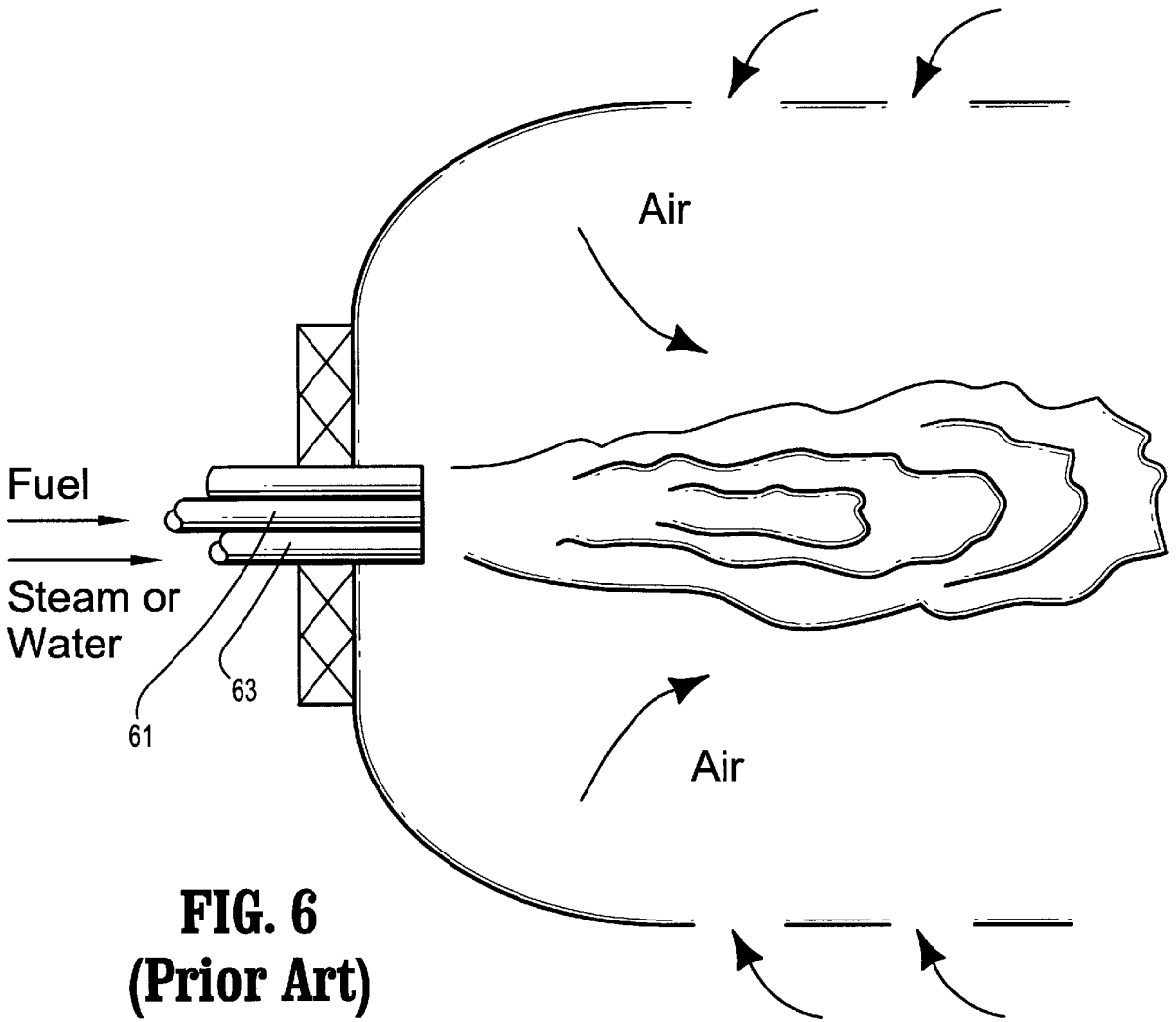
FIG. 6 (Prior Art)
FIG. 6 is a typical structure of a concentric nozzle with fuel and diluent injections for creating a turbulent flame.
Figure 7:
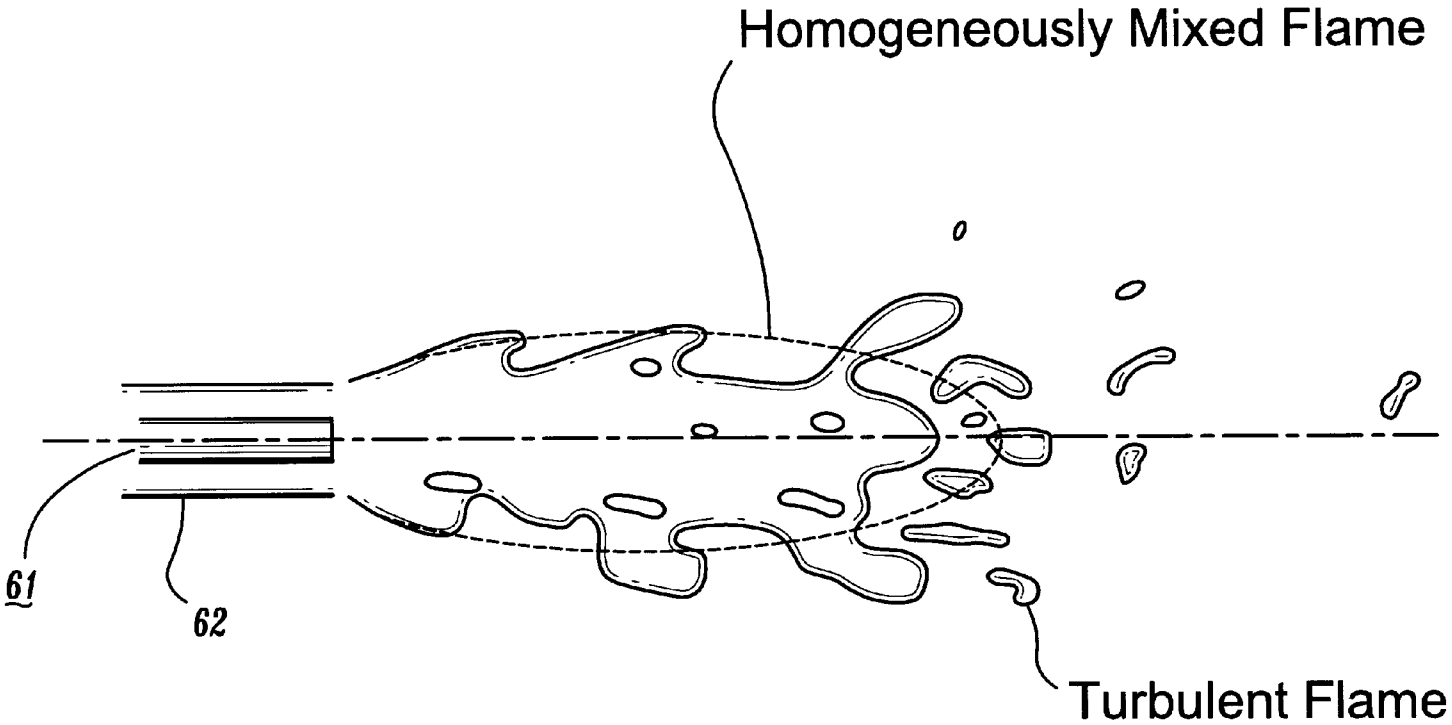
FIG. 7 illustrates a typical mixing of fuel and air using a jet mixing method.
Figure 8:
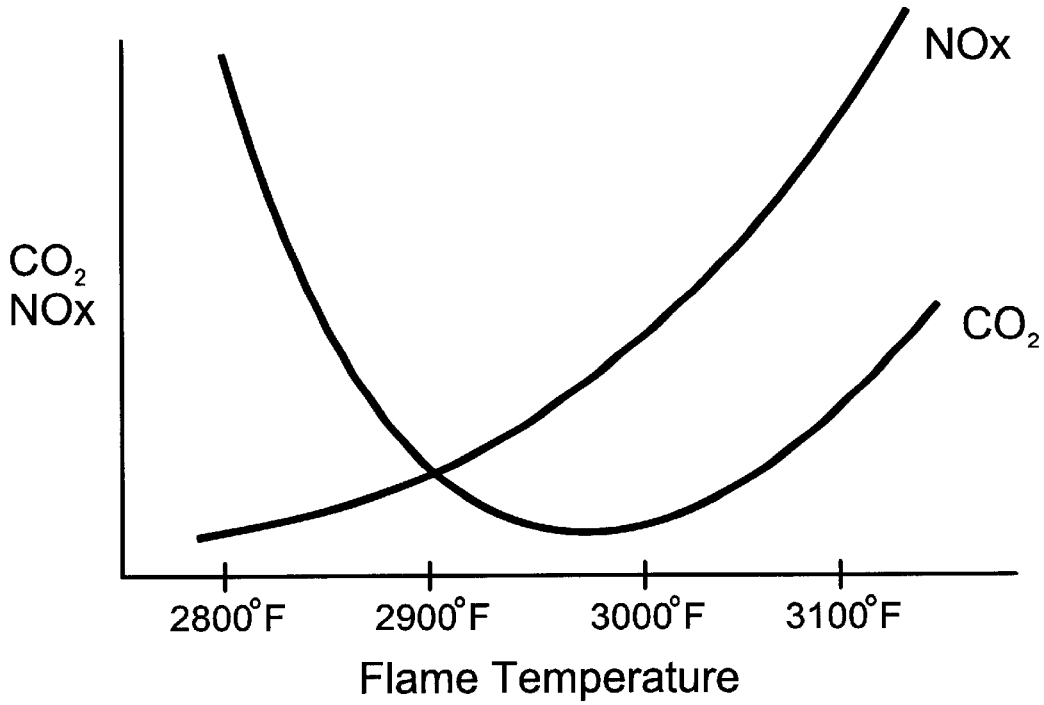
FIG. 8 illustrates typical emission products of NOx and CO as a function of flame temperature.
Figure 9:
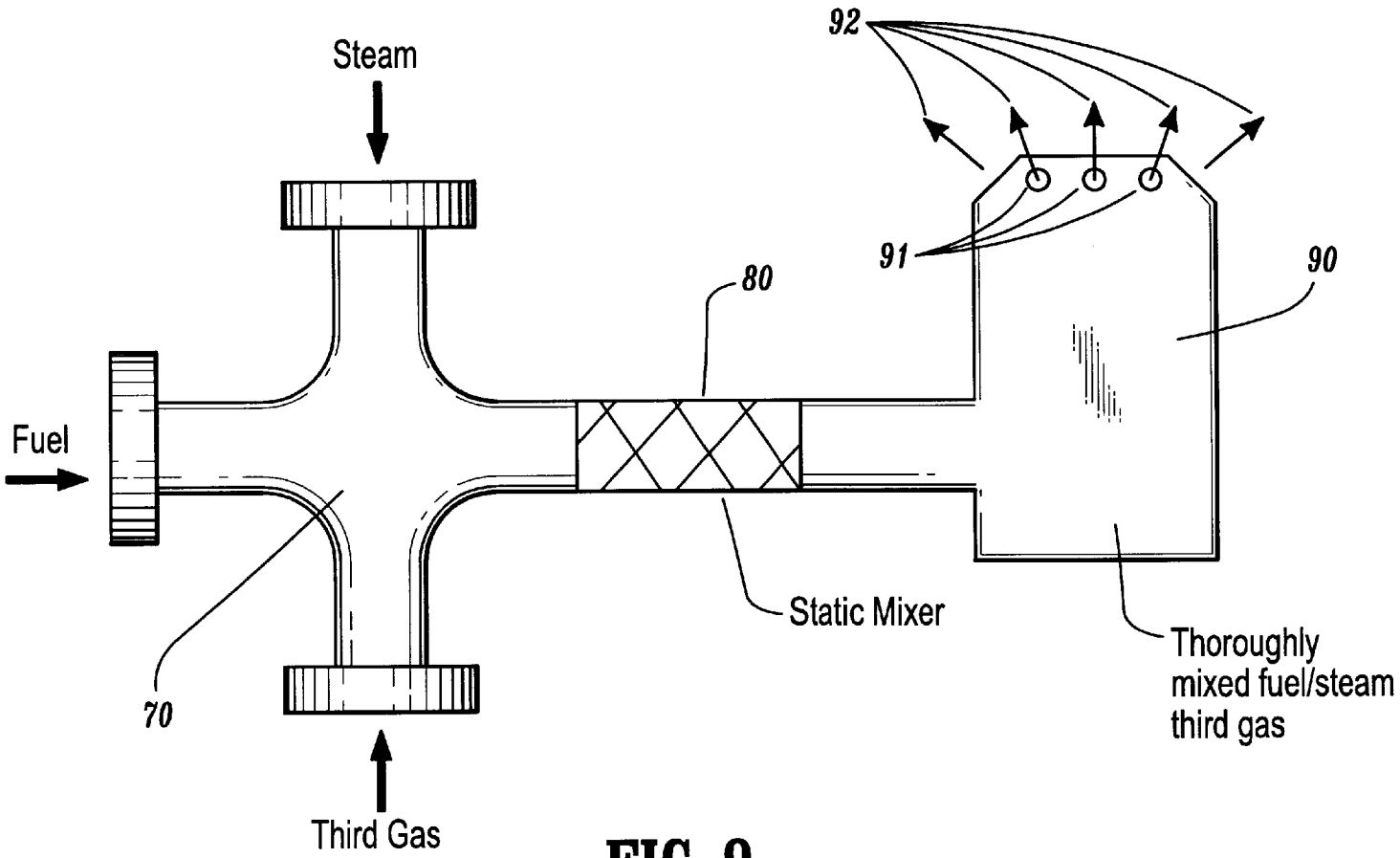
FIG. 9 illustrates the system according to a preferred embodiment, including a homogenization of fuel and diluent before they enter the fuel injection tips.

FIG. 9 illustrates a preferred embodiment for the homogenization of fuel and diluents before they enter the fuel injection tips. As illustrated, the fuel and steam sometimes mix with another gas through a compact or static mixer 80. The fuel, steam, and third gas (optional) are injected through a "cross" or "Tee" piping system 70. This mixture, passing through the static mixer 80, produces a homogeneous mixing of all fluids involved. The mixture then passes into the gas turbine nozzle 90 for combustion.

The disclosure herein significantly improves upon the percentage of homogeneity present in prior art combustion systems, which as mentioned above typically have a range of homogeneity of approximately 75%–85%. The disclosure herein achieves homogeneity of significantly greater than 85%; preferably, the homogeneity is greater than 90%, more preferably is greater than 95%, and most preferably is greater than 97%.

The chemical kinetics with steam can be improved by adding a third gas as mentioned above. For example, in a normal kitchen stove, the natural gas and air are pre-mixed before they exit the stove's burner holes. This pre-mix reduces the need for rapid diffusion of oxygen to the flame front without a turbulent flow. In the combustion of a gas turbine, on the other hand, the velocity of the combustion fluid is very high. The mixing occurs so rapidly that it will sometimes reach a blowout limit, even with recirculation. The disclosure herein teaches the introduction of the third gas, thereby providing a much lower ignition temperature as a pilot to sustain combustion at very lean mixing conditions. Some of the gases available for this purpose, such as hydrogen and hydrogen peroxide, are listed in the table in FIG. 12. Using such a third gas, or a mixture of such third gases, will ensure stable combustion under leaner conditions than at the stoichiometric ratio and at a lower flame temperature.

A flame is ordinarily at the stoichiometric ratio. "Lean" means that there is more air than fuel. In other words, the amount of fuel concentration present is reduced. This lowers the flame temperature, reducing the NOx level, but also causes the flame to be unstable. Adding a third gas in accordance with the disclosure herein accelerates the burning process, thereby stabilizing the flame.

The purposes of the pilot gas are therefore to sustain combustion and reduce NOx emissions. Using the configuration of FIG. 9, experiments have proven that the flame can be stabilized at a fuel-to-steam ratio of significantly more than 1/1, for example up to 2/1 or even 3/1; traditional nozzles were limited by fuel-to-steam ratios of close to 1/1.

Figure 10:
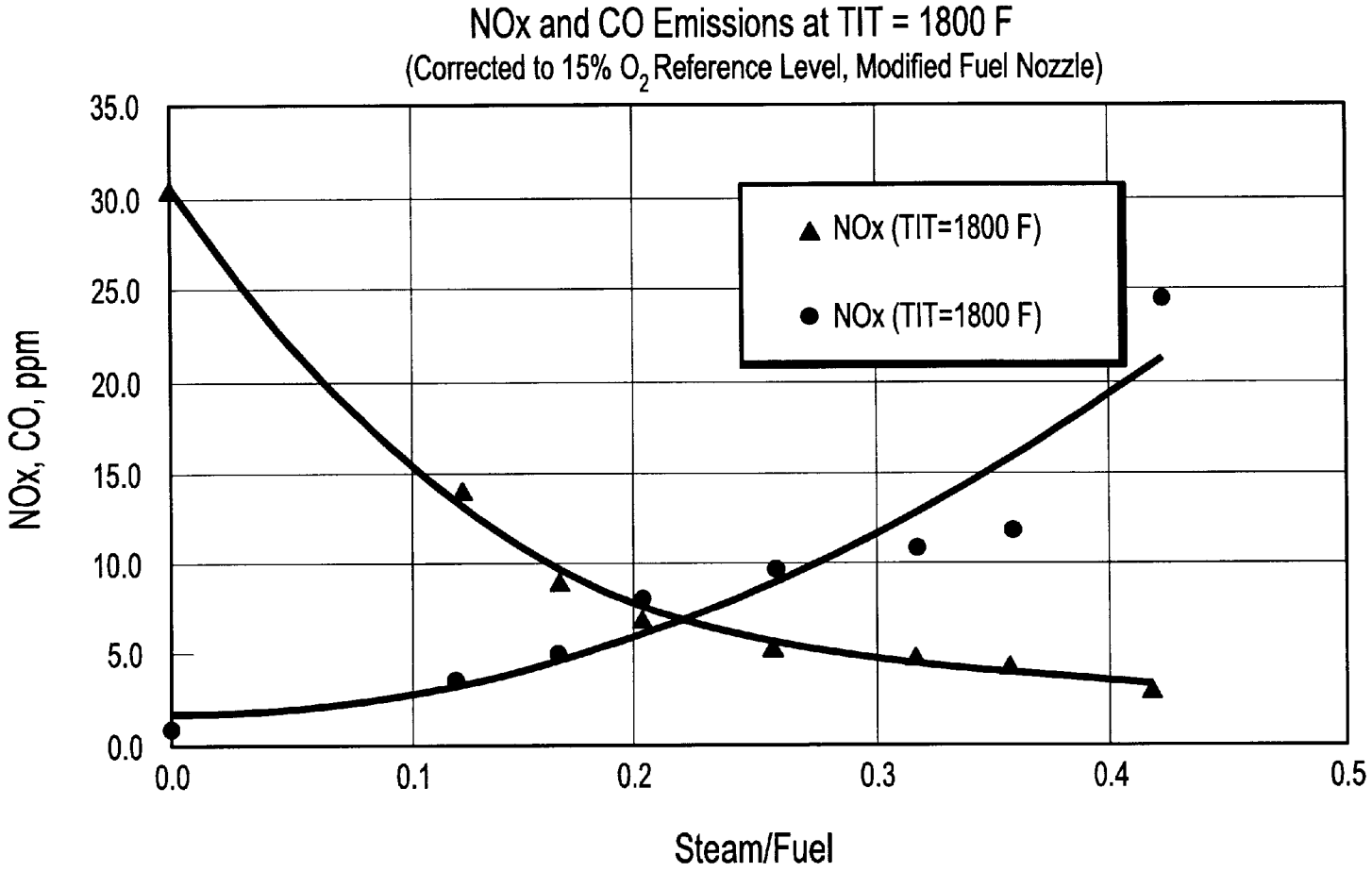
FIG. 10 is a steam-to-fuel ratio of natural gas as a function of NOx emission and CO production at a typical gas turbine discharge temperature.

FIG. 10 illustrates the results of experiments using a GE Frame 5 combustion liner transition piece and gas fuel nozzles. The steam is homogeneously mixed by the system of FIG. 9. A NOx level as low as 2 ppm has been obtained. In the region of a 5 ppm NOx level, the flame remains quite stable, with a relatively low CO production and a wide range of turndown ratios. While experimental temperatures covered the range of approximately 600 C to 1000 C, the operating region of GE Frame 5 gas turbines, FIG. 10 in particular shows the results of experiments conducted at an optimal turbine inlet temperature (TIT) of 1800 F, or approximately 982 C. To implement the control systems, the piping systems preferably use metered flows of fuel, steam, and the third gas, if necessary. The disclosure contemplates using a range of diluent-fuel ratios such as 0.2 to 1 or 0.2 to 3 along with its other teachings to both sustain flame stability and maintain low NOx emissions.

FIG. 10 is plotted in terms of the weight ratio. The weight ratio is the number of pounds of fuel vs. the number of pounds of steam. Dividing by the molecular weight gives the volume ratio. Steam has a molecular weight of 18. Methane, for example, has a molecular weight of 16. Therefore, the difference between the volume ratio and the weight ratio using methane as the fuel is relatively small (roughly 12%).

Figure 11:
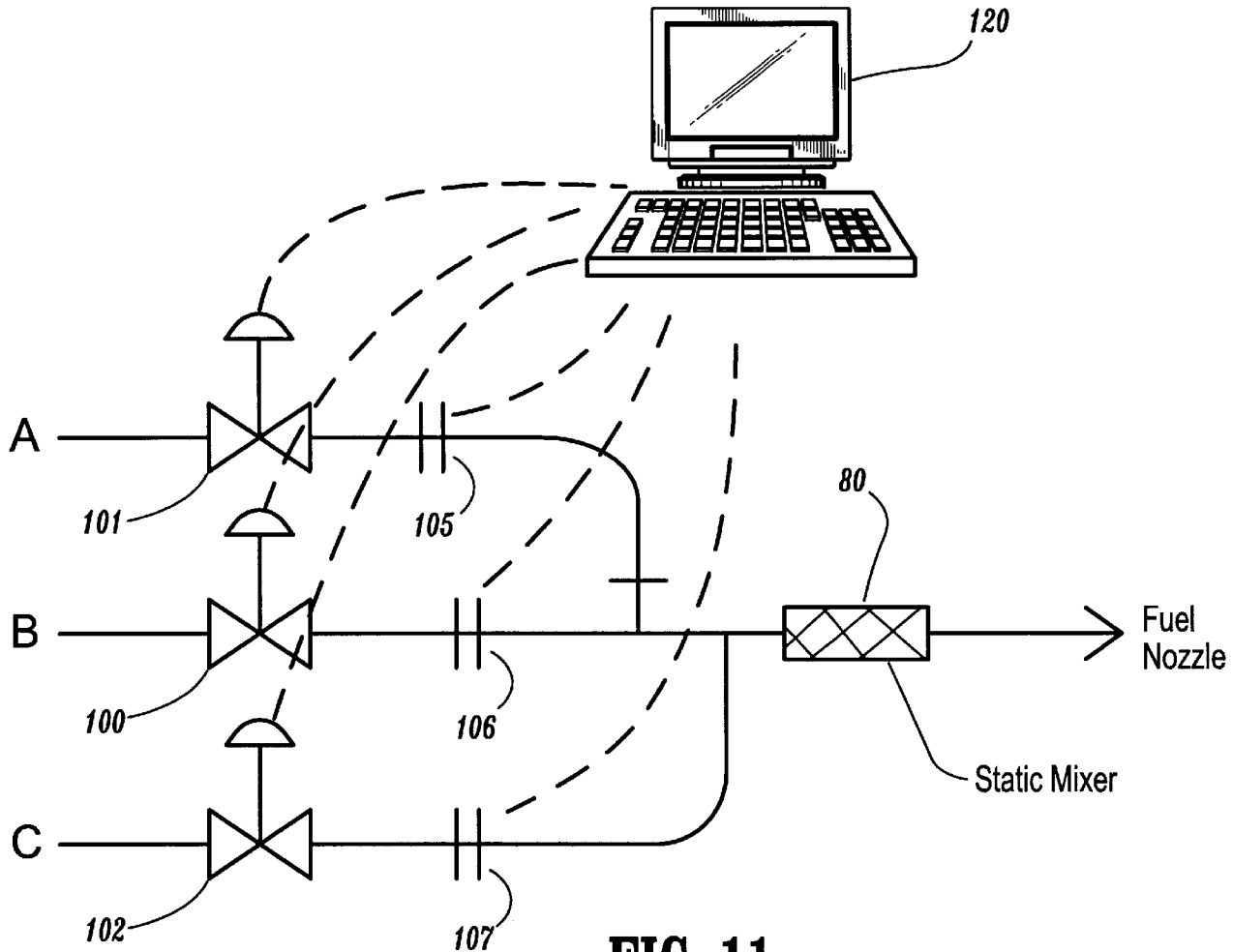
FIG. 11 illustrates a control system leading to the control of homogenized fuel diluents.

FIG. 11 is a piping diagram illustrating an embodiment with steam entering at port A through a control valve 101 and fuel entering at port B through a control valve 100. A third gas, if used, will come through port C, controlled by valve 102. The static mixer 80 is mounted downstream of all pipe connections and before the fuel nozzles. Each mixer can have a metering system. For instance, meter 105 corresponds to steam, meter 106 corresponds to fuel, and meter 107 corresponds to the third gas. To maintain the mixture ratio, computer controls use the meters as feedback to set the valve positions, providing a correct fuel-steam ratio, with the optional third gas. The objective of this design is to homogeneously mix fuel and steam before they enter combustion system nozzles. The static mixer is a means for shortening the mixing length. Alternatively, if space is available for an adequate length of pipe which can achieve homogeneous mixing, a similar result can be achieved without using static mixers.

The disclosure herein thereby teaches to reduce the level of NOx emissions in combustion systems. This is accomplished by homogeneously pre-mixing the fuel with a diluent, such as steam, before it enters the diffusion flame system. Alternative embodiments can use Argon, Helium, or other non-chemical reacting gases instead of steam. A uniform concentration distribution of a turbulent jet operates to eliminate the hot spots in a turbulent flame. The disclosure herein also teaches to simplify combustion systems by using a static mixer to save space. The disclosure herein also teaches to sustain lean combustion without flameouts, using homogeneous mixing and a pilot third gas. Ultimately, NOx emissions in combustion systems are greatly reduced at a decreased cost by means of a simplified mechanical arrangement as taught by the disclosure herein.

Figure 13:
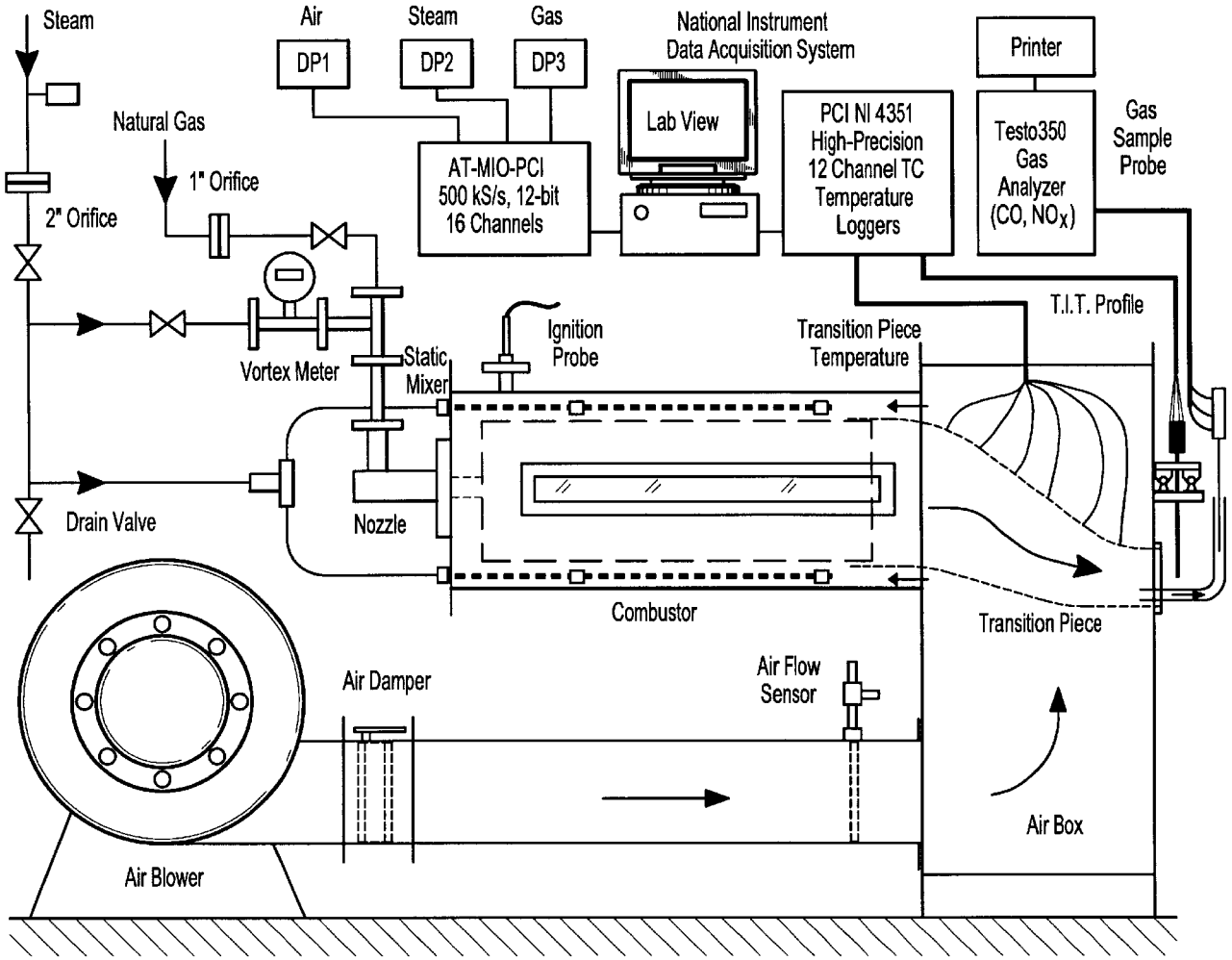
FIG. 13 is a test configuration for a gas turbine.

The teachings of the disclosure herein have been experimentally tested on full-scale gas turbine combustion systems, using test configurations such as illustrated in FIG. 13. The results indicate that much lower NOx emission levels and stable flames can be obtained compared to previously existing current concentric steam fuel nozzle systems. The results also indicate that a NOx level below that of the Dry Low NOx (DLN) systems used in today's gas turbines can be achieved without the cost and complication of a DLN system. The disclosure herein teaches a mechanical arrangement of a fuel/diluent system using a homogeneous mixing method to achieve uniform combustion properties of flames before entering the fuel nozzle as a way to reduce NOx emissions. The current design uses a well-stirred mixing principle to achieve the homogeneous combustion property of a diffusion flame. This method both simplifies the combustion system and stabilizes the flame for gas turbine systems, thereby eliminating alternatives which can be expensive such as the Selective Catalytic Reduction system (SCR) or the absorption system. This device is a significant step toward implementing NOx reduction methods for all combustion systems, particularly power plants.

The above specific embodiments are illustrative, and a person skilled in the art can introduce many variations on these embodiments without departing from the spirit of the disclosure or from the scope of the appended claims. The embodiments are presented for the purpose of illustration only and should not be read as limiting the claimed invention or its application. Therefore, the claims should be interpreted commensurate with the spirit and scope of the disclosure and its variations.

What is claimed is:

1. A method for reducing emissions in a combustion system, comprising the steps of:

creating a mixture of diluent and fuel, wherein the diluent and the fuel are at a predetermined diluent-to-fuel ratio;

homogenizing the mixture to create a mixture having a distribution of the diluent and the fuel at the predetermined diluent-fuel ratio, at homogeneity in excess of 85%; and, thereafter, introducing the homogenized mixture into a flame zone and combusting said homogenized mixture, thereby reducing NOx emissions;

wherein said fuel is a gaseous fuel, said flame is a diffusion flame, and said NOx emissions are below 15 ppm.

2. The method for reducing emissions in a combustion system as set forth in claim 1, further comprising the step of adding a pilot gas to the mixture before said homogenizing step.

3. The method for reducing emissions in a combustion system as set forth in claim 2, wherein said pilot gas is air, hydrogen, or hydrogen peroxide.

4. The method for reducing emissions in a combustion system as set forth in claim 1, wherein a homogeneity of the homogenized mixture is in excess of 97%.

5. The method for reducing emissions in a combustion system as set forth in claim 1, wherein a homogeneity of the homogenized mixture is in excess of 95%.

6. The method for reducing emissions in a combustion system as set forth in claim 1, wherein a homogeneity of the homogenized mixture is in excess of 90%.

7. The method for reducing emissions in a combustion system as set forth in claim 1, wherein said homogenizing step is performed by a compact mixer.

8. The method for reducing emissions in a combustion system as set forth in claim 1, wherein the diluent comprises steam.

9. The method for reducing emissions in a combustion system as set forth in claim 1, wherein said predetermined diluent-to-fuel ratio is in the range of 0.2 to 1.

10. The method for reducing emissions in a combustion system as set forth in claim 1, wherein said predetermined diluent-to-fuel ratio is in the range of 0.2 to 3.

11. The method for reducing emissions in a combustion system as set forth in claim 1, wherein said NOx emissions are below 12 ppm.

12. A method as in claim 1 in which said homogenizing comprises mixing said diluent and fuel through at least one static mixer selected to achieve said homogeneity in excess of 85%.

13. A method as in claim 1 in which said NOx emissions are below 9 ppm.

14. A method as in claim 1 in which said NOx emissions are below 5 ppm.

15. A method as in claim 1 in which said NOx emissions are below 3 ppm.

16. A method as in claim 1 in which said predetermined diluent-fuel ratio exceeds 2.

17. A method as in claim 1 in which said predetermined diluent-fuel ratio exceeds 2.5.

18. An apparatus for reducing emissions in a combustion system, comprising:

a chamber having a plurality of inlets to which diluent and fuel are input to create a mixture, the diluent and the fuel being at a predetermined diluent-to-fuel ratio;

a compact mixer coupled to said chamber for homogenizing said mixture to create a concentration distribution of the diluent and the fuel at the predetermined diluent-fuel ratio, at homogeneity in excess of 85%; and a flame zone disposed downstream of said compact mixer for combusting said homogenized mixture after the homogenized mixture leaves said compact mixer, thereby reducing NOx emissions;

wherein said fuel is a gaseous fuel, said flame zone is a diffusion flame zone, and said NOx emissions are reduced to below 15 ppm.

19. The apparatus for reducing emissions in a combustion system as set forth in claim 18, wherein a pilot gas is also input to said chamber through the plurality of inlets.

20. The apparatus for reducing emissions in a combustion system as set forth in claim 19, wherein said pilot gas is air, hydrogen, or hydrogen peroxide.

21. The apparatus for reducing emissions in a combustion system as set forth in claim 19, further comprising:

a first valve and a first meter for controlling an amount of diluent input into said chamber;

a second valve and a second meter for controlling an amount of fuel input into said chamber; and a third valve and a third meter for controlling an amount of the pilot gas input into said chamber.

22. The apparatus for reducing emissions in a combustion system as set forth in claim 18, wherein a homogeneity of the homogenized mixture is in excess of 97%.

23. The apparatus for reducing emissions in a combustion system as set forth in claim 18, wherein a homogeneity of the homogenized mixture is in excess of 95%.

24. The apparatus for reducing emissions in a combustion system as set forth in claim 18, wherein a homogeneity of the homogenized mixture is in excess of 90%.

25. The apparatus for reducing emissions in a combustion system as set forth in claim 18, wherein the diluent comprises steam.

26. The apparatus for reducing emissions in a combustion system as set forth in claim 18, wherein said predetermined diluent-to-fuel ratio is in the range of 0.2 to 1.0.

27. The apparatus for reducing emissions in a combustion system as set forth in claim 18, wherein said predetermined diluent-to-fuel ratio is in the range of 0.2 to 3.0.

28. The apparatus for reducing emissions in a combustion system as set forth in claim 18, further comprising:

a first valve and a first meter for controlling an amount of diluent input into said chamber; and a second valve and a second meter for controlling an amount of fuel input into said chamber.

29. The apparatus for reducing emissions in a combustion system as set forth in claim 18, wherein said NOx emissions are reduced to below 12 ppm.

30. An apparatus as in claim 18 in which said NOx emissions are reduced to below 9 ppm.

31. An apparatus as in claim 18 in which said NOx emissions are reduced to below 5 ppm.

32. An apparatus as in claim 18 in which said NOx emissions are reduced to below 3 ppm.

33. A gas turbine, comprising:

a compressor;

a chamber disposed downstream of the compressor and having a plurality of inlets for receiving diluent and fuel at a predetermined diluent-to-fuel ratio to form a mixture;

a compact mixer disposed downstream of the chamber for homogenizing the mixture to create a concentration distribution of the diluent and the fuel at the predetermined diluent-fuel ratio, at homogeneity in excess of 85%;

a combustion section disposed downstream of the compact mixer for combusting the homogenized mixture after the homogenized mixture leaves the compact mixer to produce a hot energetic flow of gas; and a turbine disposed downstream of the combustion section driven by the hot energetic flow of gas for driving said compressor, thereby reducing NOx emissions;

wherein said fuel is a gaseous fuel, said combusting comprises a diffusion flame, and said NOx emissions are reduced to below 15 ppm.

34. The gas turbine as set forth in claim 33, wherein the chamber also receives a pilot gas through the plurality of inlets.

35. The gas turbine as set forth in claim 34, wherein said pilot gas is air, hydrogen, or hydrogen peroxide.

36. The gas turbine as set forth in claim 34, further comprising:

a first valve for controlling an amount of diluent input into said chamber based on a reading of a first meter;

a second valve for controlling an amount of fuel input into said chamber based on a reading of a second meter; and a third valve for controlling an amount of the pilot gas input into said chamber based on a reading of a third meter.

37. The gas turbine as set forth in claim 33, wherein a homogeneity of the homogenized mixture is in excess of 97%.

38. The gas turbine as set forth in claim 33, wherein a homogeneity of the homogenized mixture is in excess of 95%.

39. The gas turbine as set forth in claim 33, wherein a homogeneity of the homogenized mixture is in excess of 90%.

40. The gas turbine as set forth in claim 33, wherein the diluent comprises steam.

41. The gas turbine as set forth in claim 33, wherein said predetermined diluent-to-fuel ratio is in the range of 0.2 to 1.0.

42. The gas turbine as set forth in claim 33, wherein said predetermined diluent-to-fuel ratio is in the range of 0.2 to 3.0.

43. The gas turbine as set forth in claim 33, further comprising:

a first valve for controlling an amount of diluent input into said chamber based on a reading of a first meter; and a second valve for controlling an amount of fuel input into said chamber based on a reading of a second meter.

44. A gas turbine as in claim 33 in which said NOx emissions are reduced to below 12 ppm.

45. A gas turbine as in claim 33 in which said NOx emissions are reduced to below 9 ppm.

46. A gas turbine as in claim 33 in which said NOx emissions are reduced to below 5 ppm.

47. A gas turbine as in claim 33 in which said NOx emissions are reduced to below 3 ppm.

* * * * *